US006332702B1

(12) United States Patent
Hebler et al.

(10) Patent No.: US 6,332,702 B1
(45) Date of Patent: Dec. 25, 2001

(54) HEADLIGHT FOR VEHICLE FOR LOW BEAM AND AT LEAST ONE FURTHER LIGHT FUNCTION

(75) Inventors: Verena Hebler; Steffen Wiersdorff, both of Reutlingen; Michael Hamm, Pfullingen, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/615,534

(22) Filed: Jul. 13, 2000

(30) Foreign Application Priority Data

Jul. 17, 1999 (DE) ..... 199 33 662

(51) Int. Cl.[7] ..... F21V 14/02
(52) U.S. Cl. ..... 362/523; 362/285; 362/418
(58) Field of Search ..... 362/523, 459, 362/269, 285, 418, 427, 475, 543, 544, 247, 239

(56) References Cited

U.S. PATENT DOCUMENTS 5,769,525 * 6/1998 Daumueller ..... 362/475

FOREIGN PATENT DOCUMENTS 44 35 507 A1 4/1996 (DE) .

* cited by examiner

*Primary Examiner*—Alan Cariaso
*Assistant Examiner*—Hargobind S. Sawhney
(74) *Attorney, Agent, or Firm*—Michael J. Striker

(57) ABSTRACT

A headlight for a vehicle for producing low beam light and at least one further light function has a reflector, at least one light source, an adjusting device which moves the light source relative to the reflector between a position for a light function of low beam and at least one further position for at least one further light function, the adjusting device being arranged at a rear side of the reflector under the light source, and an additional reflector arranged in a light outlet direction after the adjusting device and provided with an additional light source which is inserted in the additional reflector transversely to the optical axis.

10 Claims, 2 Drawing Sheets

HEADLIGHT FOR VEHICLE FOR LOW BEAM AND AT LEAST ONE FURTHER LIGHT FUNCTION

BACKGROUND OF THE INVENTION

The present invention relates to a headlight for a vehicle, for producing low beam and at least one further light function.

Headlights of the above mentioned general type are known in the art. One of such headlights is disclosed for example in the German patent document DE 44 35 507 A1. This headlight has a reflector and a light source which is movable by an adjusting device relative to the reflector between a position for low beam and at least one position for at least one further light function. The adjusting device is arranged at a rear side of the reflector under the light source. The light source is a gas discharge lamp and the further light function of the headlight is a high beam function. Light which is emitted by the gas discharge lamp in its lower peripheral region can be used poorly because of its uncontrolled dispersed characteristic. The adjusting device requires a space at the rear side of the reflector so that for this reason it is also difficult to use the region of the reflector under the light source. The gas discharge lamp has a long service life. However, in particular the turning-on process provides a high load for the gas discharge lamp so that a short operation of the gas discharge lamp, as for example for the function of the flashlight, is not advantageous.

SUMMARY OF THE INVENTION

Accordingly, it is an object of the present invention to provide a headlight of the above mentioned general type, which avoids the disadvantages of the prior art.

In keeping with these objects and with others which will become apparent hereinafter, one feature of present invention resides, briefly stated, in a headlight for a vehicle, in which in the light outlet direction after the adjusting device, an additional reflector is arranged in which an additional light source is inserted transversely to its optical axis.

When the headlight is designed in accordance with the present invention, it has the advantage that the space under the light source is used with the additional reflector, and the additional light source can be mounted also with the adjusting device arranged directly behind the additional reflector.

In accordance with anotherfeature of the present invention, the additional light source has a light body which extends transversely to its longitudinal axis and at least approximately in direction of the optical axis of the additional reflector. This makes possible the use of a conventional light source as the additional light source, because of mounting of the light body transversely to the optical axis of the additional reflector to extend in direction of the optical axis.

In accordance with anotherfeature of the present invention, the additional reflector with additional light source operates for providing a flashlight. This embodiment is especially advantageous for the use of a gas discharge lamp as a light source, since it does not have to be used for the flashlight as required for its service life.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
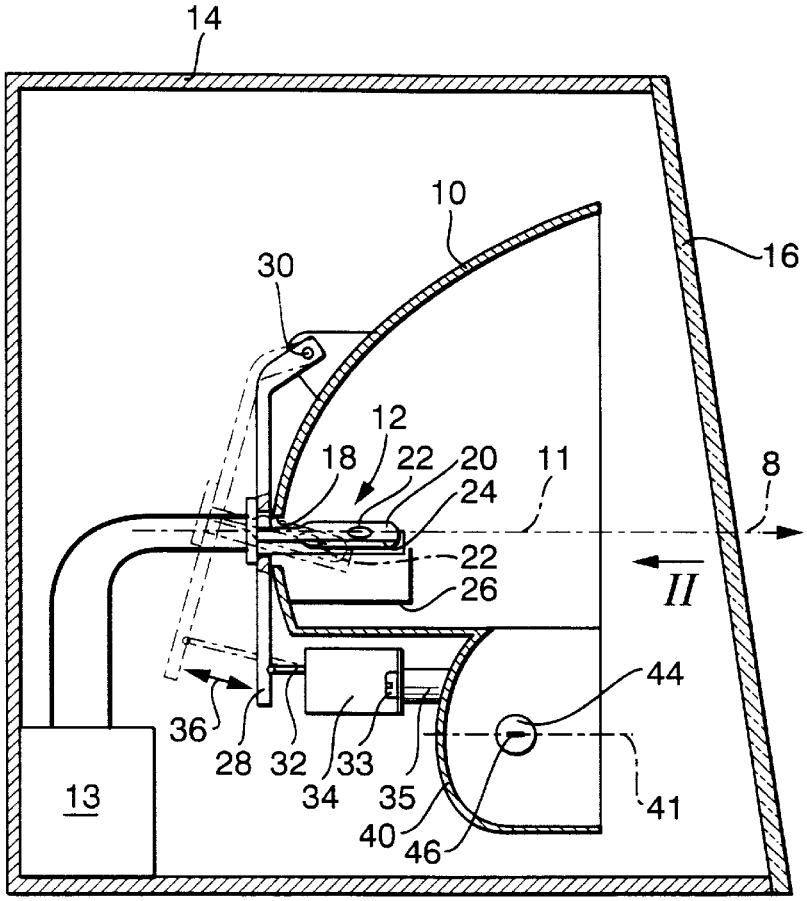
FIG. 1 is a view showing a vertical longitudinal section of a headlight in accordance with the present invention.
Figure 2:
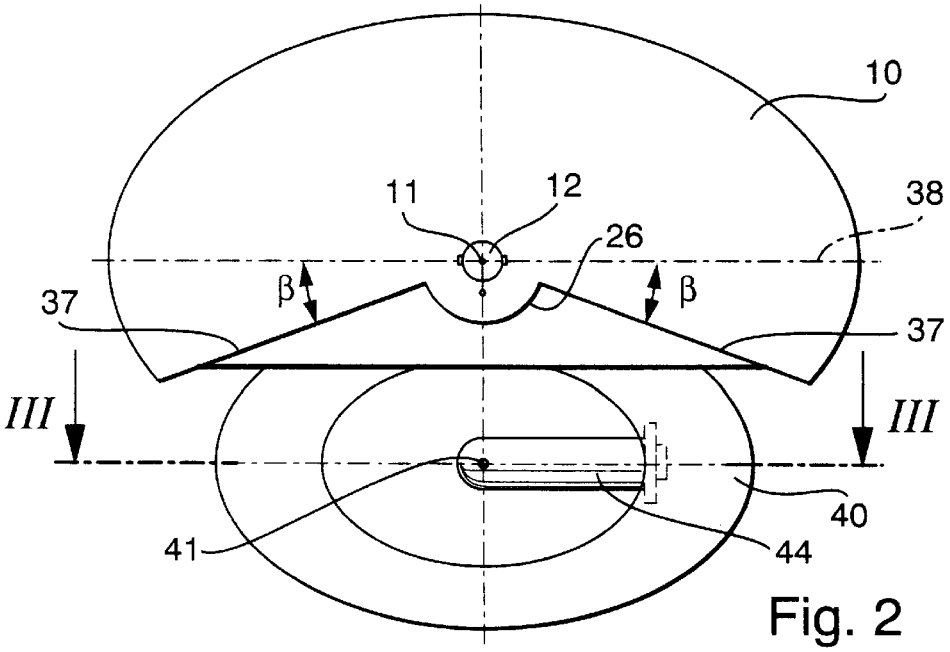
FIG. 2 is a view showing the inventive headlight on a view according to arrow 11 in FIG. 1.
Figure 3:
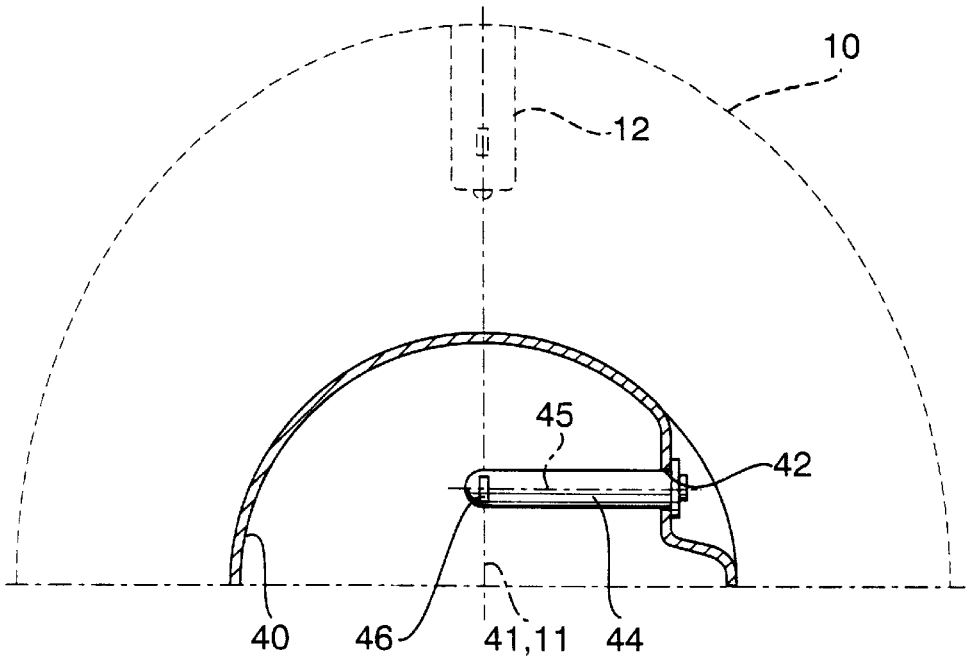
FIG. 3 is a view showing a horizontal longitudinal section of the inventive headlight taken along the line III—III in FIG. 2.

A headlight for a vehicle, in particular a motor vehicle, shown in FIGS. 1–3 operates for providing a light function of low beam, and for at least one further light function. The further light function can be for example as a light function of high beam and/or light function of fog beam. The headlight has a reflector 10 and a light source 12. The reflector 10 is adjustably supported on a holder 14, preferably in form of a housing. The light outlet opening of the housing 14 is covered by a light-permeable member or disk 16. The cover disk 16 can be formed smooth, so that the light passes through it substantially without being affected. Alternatively, the cover disk 16 can be also provided with at least local optical profiles, with which the passing light is deviated and/or dispersed.

The reflector 10 is concavely curved and has in its apex region an opening 18. The light source 12 extends through the opening 18 from the rear side into the reflector 10. The light source 12 is formed for example as a gas discharge lamp and has a burner vessel 20 which extends through the opening 18 and to the reflector 10 and in which during operation of the gas discharge lamp 12 a light ark 22 is formed as a light body. The light ark 22 extends preferably substantially in direction of the optical axis 11 of the reflector 10. The burner vessel 20 of the gas discharge lamp 12 can be provided at both sides of the light ark 22 with a strip 24 of a light-impermeable coating. A part of the light emitted by the light ark 22 is thereby screened and a bright-dark limit is produced.

A light-impermeable cap 26 can be arranged under the gas discharge lamp 12. The light emitted by the light ark 22 in a lower peripheral region is screened by the cap. For the operation of the gas discharge lamp 12, an electrical switching device 13 is provided. It produces high voltage required for ignition of the gas discharge lamp 12 and guarantees after the ignition a stable operation of the gas discharge lamp 12. The switching device 13 can be subdivided into an ignition part and a control part which can be arranged separately from one another.

The gas discharge lamp 12 is inserted in a lamp support 28 and mounted on it by one or more not shown holding elements. The lamp support 28 is arranged at the rear side of the reflector 10. The reflector 10 is turnably supported in its upper edge region around an axis 30 which extends approximately perpendicular to the optical axis 11 of the reflector 10 and at least approximately horizontally. An adjusting element 32 of an adjusting device 34 engages the lower edge region of the lamp support 28.

The gas discharge lamp 12 is arranged in the lamp support 28 between the upper and lower edge regions.

The adjusting device 34 moves the adjusting element 32 in direction of the double arrow 36 of FIG. 1, and thereby a turning of the lamp support 28 around the axis 30 is performed. The gas discharge lamp 12 moves here relative to the reflector 10. In FIG. 1 the lamp support 28 and the gas discharge lamp 12 are shown in solid lines in a first position, in which it is located for the light function of low beam. In FIG. 1 the lamp support 28 and the gas discharge lamp 12 are shown in broken lines in a second position, in which it is located for the light function of high beam. In the second position, the light ark 22 of the gas discharge lamp 12 is moved downwardly relative to the first position towards the apex of the reflector 10 and relative to the optical axis 11.

The adjusting device 34 can include, for example an electric motor as a drive, which through a transmission moves the adjusting element 32 in accordance with a double arrow 36. Alternatively, the adjusting device 34 can have an electromagnetic drive, or a hydraulic or pneumatic drive. The adjusting device 34 is mounted on the reflector 10, for example by one of several screws 32. They are screwed from the rear side of the reflector 10 in corresponding numbers into the projecting dome 35.

When the gas discharge lamp 12 is located in its position for the light function of low beam, light emitted by its light ark 22 is reflected by the reflector 10 as a low beam light bundle with an asymmetric upper bright-dark limit. When the cover disk 16 has optical profiles, then the light reflected by the reflector 10 is deviated and/or dispersed during passage through the cover disk 16 for producing the low beam light bundle.

Figure 4:
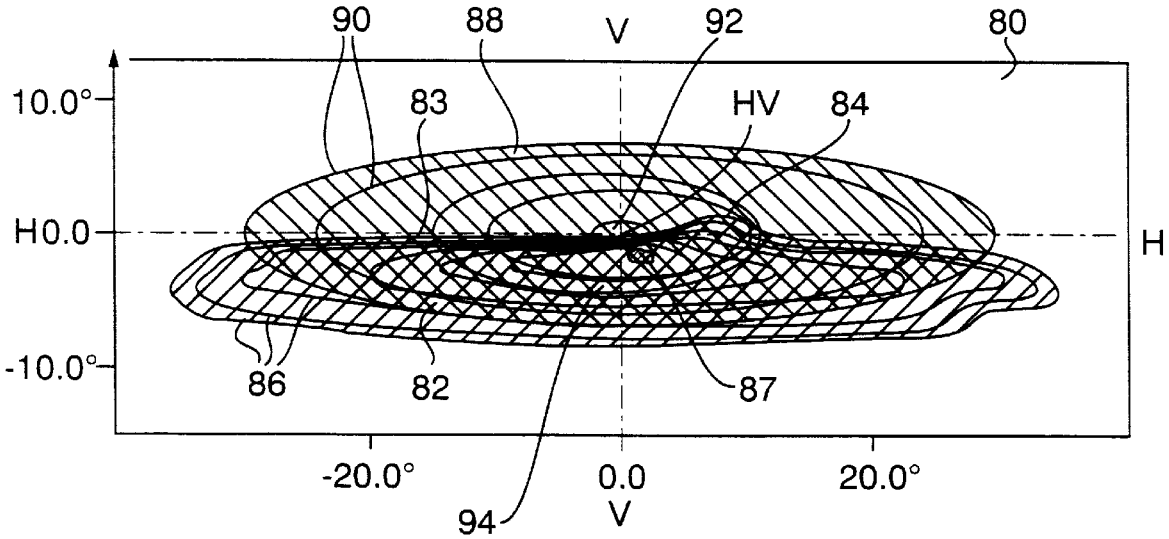
FIG. 4 is a view showing a measuring screen arranged at a distance from the inventive headlight.

FIG. 4 shows a measuring screen 80 which is arranged at a distance from the headlight and is illuminated by the light bundle emitted by the-headlight. The measuring screen 80 has a vertical central plane VV and a horizontal central plane HH, which intersect in a point HV. The low beam light bundle emitted by the headlight illuminates the measuring screen 8 in a region 82. The region 82 is limited from above by a bright-dark limit which at the left side of the measuring screen 80 has a horizontal portion 83 substantially under the horizontal central plane HH, and at the right side of the measuring screen 80 has a raising portion 84 extending from the horizontal portion 83. The arrangement of the portions 83, 84 of the bright-dark limit is connected with the embodiment of the headlight for right traffic and is changed when it is formed for left traffic. The illumination intensity distribution in the region 82 is identified with several lines 86 having the same illumination intensity. The maximum illumination intensity is provided under the bright-dark limit 83, 84 near the vertical central plane VV.

When the gas-discharge lamp 12 is located in its position for the light function of high beam, then light emitted by its light ark 22 is reflected by the reflector 10 as a high beam light bundle. The reflector 10 extends over the upper peripheral region of the gas discharge lamp 12 and downwardly in segments at both sides of the gas discharge lamp 12 to a corresponding plane 27. The plane 27 extends through the reflector 10 under an angle β of substantially 10°–25°, preferably 22° to a horizontal plane 38 which includes the optical axis 11.

In accordance with a present invention, an additional reflector 40 is arranged under the gas discharge lamp 12 after the adjusting device 34 as considered in the light outlet direction 8. The additional reflector 40 is concavely curved. The additional reflector 40 can be connected with the reflector 10 as a separate component, or can be formed preferably integral of one piece with the reflector 10. The apex of the additional reflector 40 as shown in FIGS. 1 and 3, is offset relative to the apex of the reflector 10 in the light outlet direction 8 since the adjusting device 34 is located behind the additional reflector 40. The dome 35 for mounting the adjusting device 34 is arranged at the rear side of the additional reflector 40.

The additional reflector 40 as shown in FIGS. 2 and 3 has an opening 42 which is provided in a peripheral region and through which an additional light source 44 is inserted. The opening 42 in the mounting condition of the additional reflector 40 is arranged preferably in a lateral peripheral region of the additional reflector 40 and extends with its axis substantially horizontally and perpendicular to the optical axis 41 of the additional reflector 40. With sufficient mounting space, the opening 42 in the additional reflector 40 can be also arranged in the lower peripheral region, so that the additional light source 44 can be inserted into the additional reflector 40 from below. The optical axis 41 of the additional reflector 40 extends substantially parallel to the optical axis 11 of the reflector 10. An incandescent lamp is used for example as the additional source light 44. In particular, a halogen incandescent lamp of the type H3 is suitable. It has a light body which is formed as an incandescent coil 46 extending at least approximately perpendicularly to the longitudinal axis 45 of the additional light source 44.

When the additional light source 44 is inserted in the opening 42 of the additional reflector 40 its incandescent coil 46 extends substantially in direction of the optical axis 41 of the additional reflector 40. The additional light source 44 is mounted on the additional reflector 40 in a conventional not shown manner. With the arrangement of the additional light source 44 transversely to the optical axis 41 of the additional reflector 40 it can be mounted and dismounted without a free space at the rear side of the additional reflector 40. Such free space may not provided because of the adjusting device 34 arranged there. The incandescent coil 46 of the additional light source 44 can be arranged also perpendicularly or inclined at any angle to the optical axis 41 of the additional reflector 40. However, its parallel arrangement relative to the optical axis 41 is especially advantageous for producing an additional high beam light bundle.

The additional reflector 40 with the additional light source 44 serve for example for the light function of additional high beam. For example the additional reflector 40 and the additional light source 44 can be arranged so that the light emitted by the additional reflector 40 from the additional light source 44 is reflected as a concentrated additional high beam bundle which illuminates a region 94 of the measuring screen 8 as shown in FIG. 4. The region 94 extends around the point HV. The region 94 is located inside the region 88 which is illuminated by the high beam light bundle reflected by the reflector 10. With the additional high beam light bundle, the maximum illumination intensity is increased in the zone 92 of the region 88, and thereby illumination of the far region is intensified. The shape of the additional reflector 40 can be optimized for the function of the additional high beam to the additional light source 44, since due to the cap 26 no light emitted by the gas discharge lamp 12 acts on the additional reflector 40.

The additional reflector 40 with the additional light source 44 can be used in particular for the function of flashlight, in which the additional light source 44 is operated only over a short time. For this purpose the additional light source 44 in form of an incandescent lamp is suitable better than the light source 12 in form of the gas discharge lamp, whose service life is reduced due frequent ignition processes and starting operational conditions.

The additional reflector 40 with the additional light source 44 can also serve for another additional light function than an additional high beam. For example they can operate for the function of fog light, a curve light oriented at one side, or as a one-side oriented turning light.

It will be understood that each of the elements described above, or two or more together, may also find a useful application in other types of constructions differing from the types described above.

While the invention has been illustrated and described as embodied in headlight for vehicle for low beam and at least one further light function, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. A headlight for a vehicle for producing low beam light and at least one further light function, comprising a reflector; at least one light source; an adjusting device which moves said light source relative to said reflector between a position for a light function of low beam and at least one further position for at least one further light function, said adjusting device being arranged at a rear side of said reflector under said light source; and an additional reflector arranged in a light outlet direction after said adjusting device and provided with an additional light source which is inserted in said additional reflector transversely to the optical axis of said additional reflector.

2. A headlight as defined in claim 1, wherein said optical axis of said additional reflector extends at least approximately parallel to an optical axis of said first mentioned reflector.

3. A headlight as defined in claim 1, wherein said at least one light source is a gas discharge lamp, said additional light source being an incandescent lamp.

4. A headlight as defined in claim 1, wherein said additional light source has a light body which extends transversely to a longitudinal axis and at least approximately in direction of an optical axis of said additional reflector.

5. A headlight as defined in claim 4, wherein said additional light source is a halogen incandescent lamp of the type H3.

6. A headlight as defined in claim 1, wherein said additional reflector with said additional light source is formed so as to provide a function of an additional high beam light.

7. A headlight as defined in claim 6, wherein said additional reflector with said additional light source is formed so as to provide a function of a flashlight.

8. A headlight as defined in claim 1, wherein said additional reflector is formed of one piece integrally with said first mentioned reflector.

9. A headlight as defined in claim 1, wherein said additional reflector has an apex which is offset relative to an apex of said first mentioned reflector in a light outlet direction.

10. A headlight as defined in claim 1, wherein said additional light source is arranged in a side peripheral region of said additional reflector.

* * * * *